US012404663B2

(12) United States Patent
Blum

(10) Patent No.: US 12,404,663 B2
(45) Date of Patent: Sep. 2, 2025

(54) SANITARY INSERT PART AND SERIES FOR A SANITARY INSERT PART

(71) Applicant: Neoperl GmbH, Mullheim (DE)

(72) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 237 days.

(21) Appl. No.: 17/766,773

(22) PCT Filed: Sep. 18, 2020

(86) PCT No.: PCT/EP2020/076144
§ 371 (c)(1),
(2) Date: Apr. 6, 2022

(87) PCT Pub. No.: WO2021/069191
PCT Pub. Date: Apr. 15, 2021

(65) Prior Publication Data

US 2024/0093469 A1 Mar. 21, 2024

(30) Foreign Application Priority Data

Oct. 8, 2019 (DE) ..... 202019105541.3

(51) Int. Cl.
*E03C 1/084* (2006.01)

(52) U.S. Cl.
CPC ..... *E03C 1/084* (2013.01)

(58) Field of Classification Search
CPC ..... E03C 1/084; E03C 1/08; E03C 1/086
See application file for complete search history.

(56) References Cited

U.S. PATENT DOCUMENTS

| | | | | |
|---|---|---|---|---|
| 3,141,619 | A | 7/1964 | Benjamin et al. | |
| 4,364,523 | A * | 12/1982 | Parkison | B05B 1/323 239/590.5 |
| 5,114,072 | A | 5/1992 | Barhydt, Sr. | |
| 2021/0277639 | A1 * | 9/2021 | Birmelin | E03C 1/086 |

FOREIGN PATENT DOCUMENTS

| | | |
|---|---|---|
| CN | 203475534 | 3/2014 |
| CN | 203531059 | 4/2014 |
| CN | 108291394 | 7/2018 |
| CN | 212358482 | 1/2021 |
| DE | 29510618 | 9/1995 |
| DE | 102007047112 | 4/2009 |
| DE | 102015003246 | 9/2016 |
| DE | 202016005647 | 1/2018 |
| DE | 202016005687 | 1/2018 |
| DE | 102017105299 | 9/2018 |

* cited by examiner

*Primary Examiner* — Steven M Cernoch
(74) *Attorney, Agent, or Firm* — Volpe Koenig

(57) ABSTRACT

A sanitary insert part (1), with at least one flow-determining functional unit (2) and a diffusor (4) arranged in the flow direction (3) after the flow-determining functional unit (2), the diffusor (4) having a diffusor space (5), the diffusor space (5) is partially limited by an impact face (6) which deflects water flowing into the diffusor space (5) in a lateral direction. The diffusor space (5) has several outlet openings (7), and the impact face (6) is adjoined by a drainage ramp (8), which allows water impinging on the impact face (6) and draining therefrom to run off in the position of use in the direction of the outlet openings (7).

18 Claims, 2 Drawing Sheets

SANITARY INSERT PART AND SERIES FOR A SANITARY INSERT PART

TECHNICAL FIELD

The invention relates to a sanitary insert part having at least one flow-determining functional unit and a diffusor which in the flow direction is disposed after the flow-determining functional unit, wherein the diffusor has a diffusor space, wherein the diffusor space is partially delimited by an impact face which deflects in a lateral direction water flowing into the diffusor space, wherein the diffusor space has a plurality of outlet openings.

The invention furthermore relates to a model series having at least two variants of a sanitary insert part.

SUMMARY

The invention is based on the object of providing a sanitary insert part of the type mentioned at the outset that has improved performance characteristics.

This object is achieved according to the invention by a sanitary insert part having one or more of the features described herein and/or by a model series having one or more of the features described herein relating to a model series.

In order to achieve the object, a sanitary insert part of the type mentioned at the outset is in particular proposed according to the invention, said sanitary insert part being characterized in that the impact face is adjoined by a drainage ramp which allows water impacting the impact face and draining from the latter in the use position to drain in the direction of the outlet openings. This has the advantage that the sanitary insert part can also be used in the case of relatively low flow rates (such as, for example, of at most or exactly 1 gallon per minute (gpm)) in order to configure a nicely shaped and/or aerated water jet.

In the case of minor flow rates of this type, a sufficient aeration of the water jet can no longer be achieved using sanitary insert parts of the type known from the prior art so that a jet pattern of an outflowing water jet has an irregular effect. Moreover, as opposed to previously known sanitary insert parts of the type mentioned at the outset, noise which is often considered to be annoying can be more readily prevented because turbulences within the built-in part, in particular within the diffusor space and/or in the flow direction after the outlet openings, are minor in comparison to previously known built-in parts.

In order to achieve the object, a sanitary insert part of the type mentioned at the outset is moreover in particular proposed according to the invention, said sanitary insert part being characterized in that the outlet openings penetrate an encircling lateral wall of the diffusor, in that the outlet openings each have a width b, in that two adjacent outlet openings are in each case disposed at a mutual spacing a, and in that a ratio b/a is less than 0.41. It has proven particularly advantageous for the ratio b/a in built-in parts having more minor flow rates (low flow ratings) to be kept below 0.41 because a poorly aerated and/or misshapen water jet was observed at values above this. It can thus be achieved by this ratio that a sufficient aeration of the water jet takes place in particular at minor flow rates such as, for example, 1 gpm.

The two independent solutions described above can also be combined with one another so as to form one advantageous design embodiment.

Advantageous design embodiments of the invention which can be combined individually or in combination with the features of other design embodiments, optionally conjointly with the features noted above are described hereunder.

According to one advantageous refinement, it can be provided that the diffusor space has at least one inlet opening, wherein a water jet entering through the at least one inlet opening in the use position impacts the impact face and is split. A positive aeration of the water jet is thus also possible at a minor flow rate. In particular, a plurality of inlet openings which are preferably all directed toward the impact face can also be provided. The at least one inlet opening can in particular be configured by the functional unit.

In order to be able to achieve a particularly good distribution of the water jet, the impact face in terms of an incident angle of the inflowing water jet in the use position can be aligned so as to be perpendicular or almost perpendicular.

In order to accelerate draining of the water impacting the impact face, it can be provided according to a further advantageous design embodiment that the drainage ramp in relation to the impact face is inclined downward and/or from the inside to the outside by an angle. The angle can in particular be at least 5°, in particular at least 10°, in particular at least 15°, in particular at least 20°, in particular at least 25°, preferably approximately 30°.

According to a further advantageous design embodiment the diffusor space can be configured in the shape of a ring. Alternatively or additionally thereto, it can be provided that the outlet openings are at least partially configured as material clearances that run toward the outside, preferably material clearances that run radially toward the outside. In particular, the material clearances can each have a minimum dimension which corresponds to at least 2%, in particular at least 3%, in particular at least 4%, in particular at least 5%, in particular at least 6%, in particular at least 7%, in particular at least 8%, in particular at least 9%, in particular at least 10%, of a diameter of the diffusor space. The water jets exiting the outlet openings can thus be rectified prior to exiting in order to be able to generate a homogenous aerated jet pattern.

According to one advantageous design embodiment it can be provided that the diffusor space is configured between the impact face and the flow-determining functional unit. Alternatively or additionally, it can be provided that a diffusor ring is configured or disposed so as to be downstream of the outlet openings.

According to one further advantageous design embodiment it can be provided that the flow-determining functional unit has at least one flow rate regulator and/or at least one throttle. It is thus possible for a predefined flow rate to be directed into the diffusor. It can be particularly advantageous for the functional unit to have at least one flow rate regulator so that a required and/or desired flow rate within an operating range is able to be provided independently of the pressure. The flow conditions in the diffusor space can thus be better controlled.

According to one particularly advantageous design embodiment it can be provided that the sanitary insert part has a housing in which the diffusor and/or the at least one flow-determining functional unit are/is at least partially inserted. The housing can preferably have an encircling, in particular closed, wall which laterally delimits an in particular annular trap that in the flow direction is disposed downstream of the outlet openings. The housing can be configured, for example, as a diffusor ring which forms an outer and/or a lateral delimitation of an annular chamber/trap.

In order to achieve particularly good splitting of a water jet impacting the impact face, it can be provided according to one advantageous refinement that at least one splitter element is disposed at and/or on the impact face, in particular on the periphery of the impact face. In particular, a plurality of splitter elements which preferably lie on a circular path can be disposed on the impact face. Alternatively or additionally, the splitter elements as a flow obstacle, in the radial direction and/or in terms of a flow direction, for example the flow direction already mentioned above, can in each case be disposed ahead of an outlet opening.

In order to be better able to prevent turbulences within the diffusor space, according to one advantageous refinement a collection chamber can be configured between the outlet openings and an outer periphery of the drainage ramp within the diffusor space. A height of the diffusor space in the region of the collection chamber can preferably be greater than a height of the diffusor space in the region of the impact face. Alternatively or additionally, it can be provided according to one advantageous refinement that an outer periphery of the drainage ramp, for example the outer periphery of the drainage ramp already mentioned above, is configured by a step. The draining water at this location thus runs off a breakaway edge, in particular a blunt breakaway edge, of the drainage ramp, as a result of which said water experiences an acceleration prior to flowing through the outlet openings.

Moreover proposed for achieving the above object is a model series for at least two variants of a sanitary insert part, in particular wherein at least one of the at least two variants corresponds to a sanitary insert part as is described and claimed herein.

The model series comprises at least one functional unit, at least one housing, and at least two different types of diffusors. The housing can be configured as a diffusor ring, for example. The model series is characterized in that the at least two variants have different types of diffusors, in that the at least two types of diffusors have differently configured flow-determining outlet openings. In particular, a first type here can have a lower flow rating than a second type. As has already been explained above, the first variant can be a flow rating of which the flow rate is at most 1 gpm, in particular exactly 1 gpm, or is less than 1 gpm. Accordingly, the second variant has a higher flow rating having a flow rate of more than 1 gpm.

In other words, proposed is a model series having at least two variants of a sanitary insert part, wherein each variant has at least one functional unit, at least one housing and/or a diffusor ring, and at least one diffusor, characterized in that the at least two variants have different types of diffusors, in that the at least two types of diffusors have differently configured flow-determining outlet openings, in particular wherein the first variant has a lower flow rating than the second variant.

Advantageous design embodiments of the invention which can be combined individually or in combination with the features of other design embodiments, optionally conjointly with the features of the coordinate claim relating to a model series are described hereunder. Moreover, the features of the sanitary insert part described and/or claimed herein can in particular be utilized in order to form further design embodiments according to the invention.

According to one advantageous refinement, it can be provided that a ratio between a width b of an outlet opening and a spacing a between two adjacent outlet openings in the first type of diffusor is smaller than in the second type. It is thus possible to be able to provide sanitary insert parts of different flow ratings (and/or variants of flow ratings) by means of the model series, wherein only different types of diffusors have to be used in order for this to be achieved. The correct diffusor can thus be chosen depending on the flow rate and inserted into the housing so as to configure a sanitary insert part.

According to one particularly preferred design embodiment of the model series it can be provided that the first variant is configured as a sanitary insert part as described herein.

In order to be able to produce sanitary insert parts of different flow ratings, it can be provided that the ratio b/a of the first variant is less than 0.41 and/or that the ratio b/a of the second variant type is 0.41 or more than 0.41.

In order to keep the production costs of the sanitary insert parts that can be produced by means of the model series as low as possible, it can be provided according to a further advantageous design embodiment that the housing and/or a diffusor ring of the at least two variants are/is of an identical construction. The housing here can relate to the diffusor ring, or these may be different components.

According to one refinement it can be provided that the second variant does not have any drainage ramp on the diffusor. Other flow characteristics than in the first variant can thus be achieved here.

BRIEF DESCRIPTION OF THE DRAWINGS

The invention will now be explained in more detail by means of a plurality of exemplary embodiments but is not limited to these exemplary embodiments. Further exemplary embodiments are derived by combining the features of individual or a plurality of claims with one another and/or with individual or a plurality of features of the exemplary embodiments.

In the figures.

DETAILED DESCRIPTION

Figure 1:
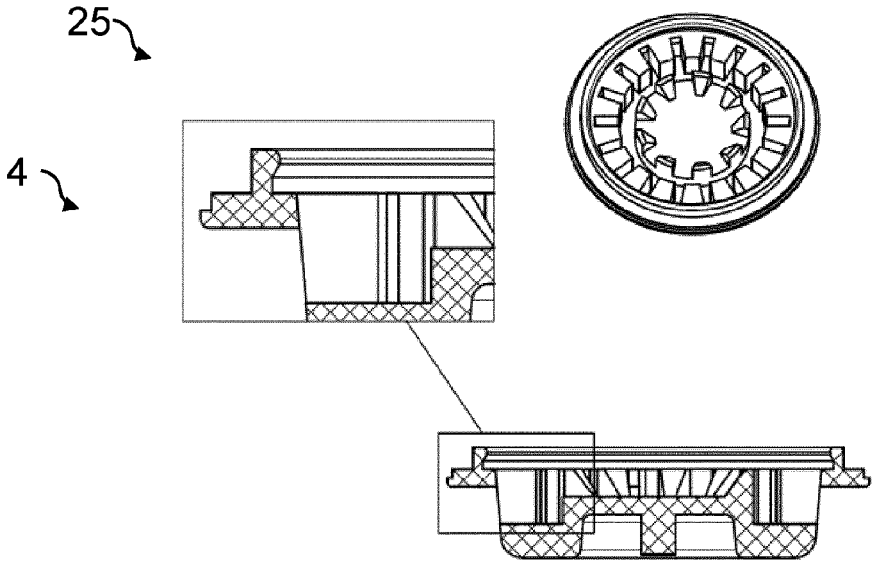
Fig. 1 Prior Art
FIG. 1 shows a previously known variant of a design embodiment of a sanitary insert part (may correspond to the second variant), wherein only a diffusor but no flow-determining functional unit is illustrated, wherein the diffusor has a diffusor space, wherein the diffusor space is partially delimited by an impact face which deflects in a lateral direction water flowing into the diffusor space, wherein the diffusor space has a plurality of outlet openings.
Figure 3:
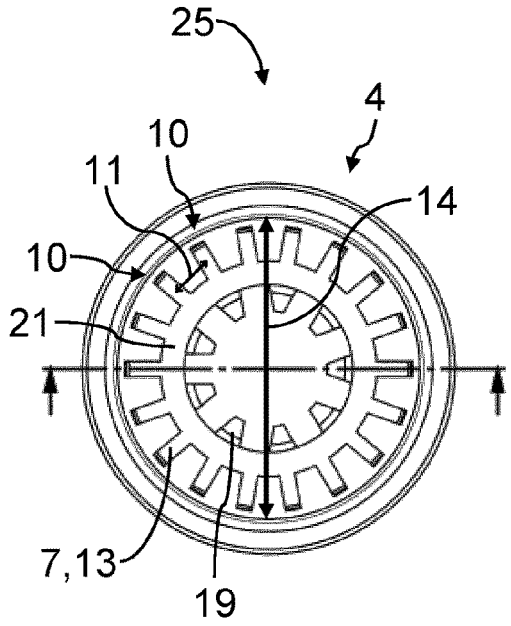
Fig. 3 Prior Art
FIG. 3 shows a plan view of the diffusor type of the variant of the sanitary insert part from FIG. 1, wherein an encircling lateral wall of the diffusor is penetrated by a plurality of outlet openings each having a respective width (b), wherein the outlet openings are disposed in such a manner that two adjacent outlet openings are in each case disposed so as to be spaced apart at a mutual spacing (a)
Figure 5:
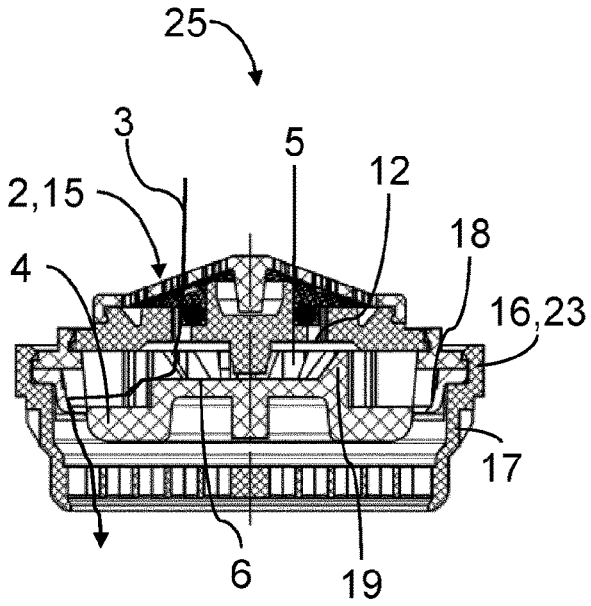
Fig. 5 Prior Art
FIG. 5 shows a sectional illustration of the sanitary insert part from FIG. 3, wherein a functional unit in the flow direction is disposed upstream of the diffusor.

Variants of an embodiment of sanitary insert parts which are known per se from the prior art and are configured for shaping a water jet exiting an outlet fitting are shown in FIGS. 1, 3 and 5. To this end, the water jet is aerated by suctioning air which is mixed with the water within the built-in part.

The invention thus relates to a sanitary insert part which is in particular configured as a jet regulator, preferably as an aerated jet regulator. Built-in parts of this type typically have at least one flow-determining functional unit 2 and a diffusor 4 which in the flow direction 3 is disposed after the flow-determining functional unit 2.

Such a diffusor 4 has a diffusor space 5 which in terms of the dimensions thereof is at least partially delimited by an impact face 6.

The impact face 6 is configured in the use position and/or during the operation for deflecting in a lateral direction water flowing into the diffusor space 5. The diffusor space 5 per se has a plurality of outlet openings 7 through which the water jet which has split on the impact face 6 exits the diffusor space 5 in the form of individual jets.

However, it has been demonstrated that no sufficient aeration of a water jet flowing through, shaped in and aerated in the built-in part takes place specifically at minor flow rates which can be, for example, in the range from 1 gpm+/−10%, in particular +/−20%. Therefore, no appealing outflow jet pattern considered desirable by the customers can be generated using previously known built-in parts.

Figure 2:
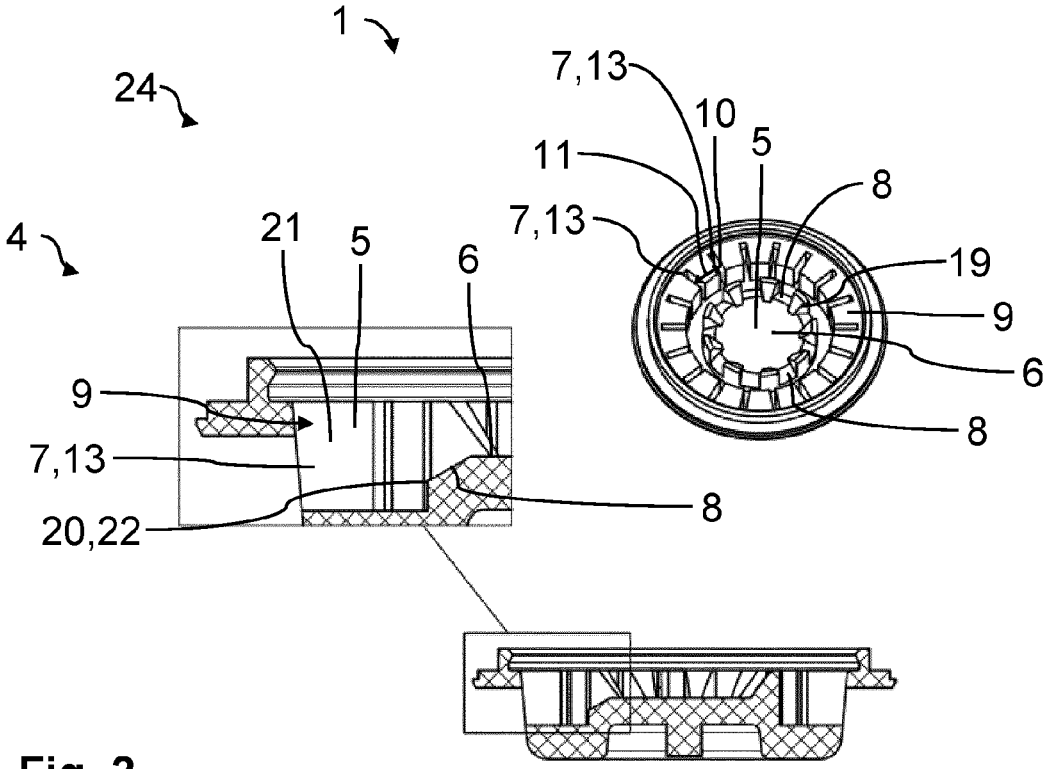
FIG. 2 shows an exemplary variant of a design embodiment of a sanitary insert part according to the invention (may correspond to the first variant) which as opposed to the built-in part from FIG. 1 has a drainage ramp which directly adjoins the impact face and which allows water impacting the impact face and draining from the latter in the use position to drain in the direction of the outlet openings, preferably wherein the built-in part is designed as a jet regulator.
Figure 4:
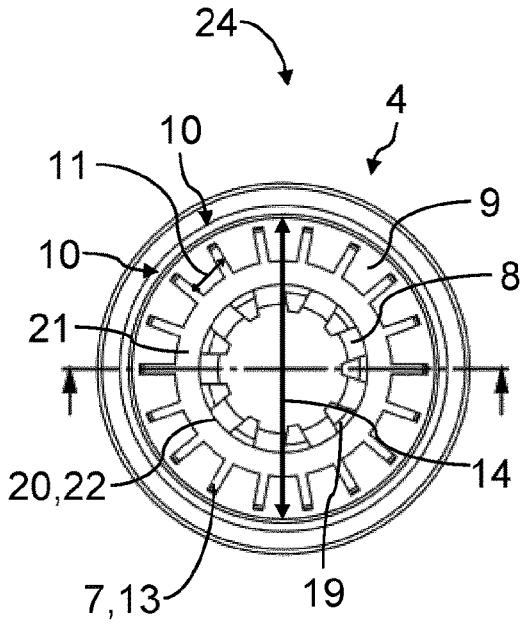
FIG. 4 shows a plan view of the diffusor type of the variant of the sanitary insert part from FIG. 2, wherein the outlet openings are designed so as to be narrower, thus have a smaller width (b), in comparison to the diffusor type from FIGS. 1 and 3.
Figure 6:
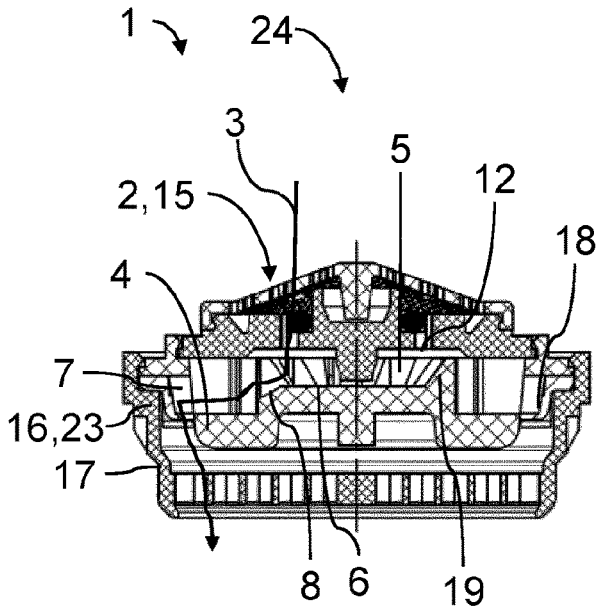
FIG. 6 shows a sectional illustration of the sanitary insert part from FIG. 4, wherein a functional unit in the flow direction is likewise disposed upstream of the diffusor, and wherein the embodiment from FIG. 6 in comparison to that of FIG. 5 differs only in terms of the diffusor type.

FIGS. 2, 4 and 6 show a potential variant of an embodiment of a sanitary insert part according to the invention which in its entirety is identified by the reference 1.

The sanitary insert part 1 in comparison to previously known built-in parts has the advantage that also minor flow rates of water can be sufficiently aerated therewith so that an appealing aerated outflow jet pattern is generated.

In order for it to be possible for a quantity of water flowing into the diffusor space 5 to also be sufficiently split therein, the diffusor space 5, as has already been described previously in the context of the previously known built-in part, has an impact face 6 which at least partially delimits the diffusor space 5.

The sanitary insert part 1 now is distinguished in that the impact face 6 is adjoined by a drainage ramp 8 which accelerates water impacting the impact face 6 and running off the latter in the direction of the outlet openings 7, allowing said water to drain. The drainage ramp 8 can thus serve for accelerating draining water in order for the latter to be transported in the direction of the outlet openings 7.

It has furthermore proven advantageous for the outlet openings 7 to establish a lateral outlet direction, in particular a lateral outlet direction which runs parallel or almost parallel to the impact face 6. This can be achieved in that the outlet openings 7 penetrate an encircling lateral wall 9 of the diffusor 4.

The outlet openings 7 each have a width b, 10. Adjacent outlet openings 7, particular all adjacent outlet openings 7, can be disposed at equal mutual spacings a, 11. In the built-in part 1 according to the invention it has proven advantageously in terms of producing an optimal outflow jet pattern at minor flow rates for a ratio b/a (b divided by a) to be less than 0.41.

The diffusor 4 has at least one inlet opening 12, wherein a water jet which in the use position enters through the at least one inlet opening 12 impacts the impact face 6 and is split. Therefore, the at least one inlet opening 12 is configured in such a manner that an entry direction of the water jet by way of said inlet opening 12 is established such that said water jet impacts the impact face 6, in particular impacts exclusively the impact face 6. The sanitary insert part 1 can have a plurality of inlet openings 12, all of which are in particular aligned toward the impact face 6 and/or disposed above the impact face 6.

The impact face 6 in terms of the inflowing water jet is aligned such that a high flow resistance is created. This can be achieved in that the impact face 6, which is able to be configured as an impact plane, in terms of an incident angle of the inflowing water jet in the use position is aligned so as to be perpendicular or almost perpendicular.

The drainage ramp 8 in relation to the impact face 6, in particular in relation to a plane of the impact face 6, is inclined downward and/or from the inside to the outside by an angle. This angle can be at least 5°, in particular at least 10°, particular at least 15°, in particular at least 20°, in particular at least 25°, preferably approximately 30°.

The diffusor space can be configured in the shape of a ring or a disk.

The outlet openings 7 in the design embodiments shown in FIGS. 1 to 6 are at least partially configured as outwardly running material clearances 13. Therefore, the material clearances 13 can act as channels so as to minimize flow turbulences.

The material clearances 13 can each have a minimum dimension which corresponds to at least 2%, in particular at least 3%, in particular at least 4%, particular at least 5%, particular at least 6%, in particular at least 7%, in particular at least 8%, in particular at least 9%, in particular at least 10%, of a diameter 14 of the diffusor space 5.

The diffusor space 5 is configured between the impact face 6 and the flow-determining functional unit 2, wherein said diffusor space 5 on the inflow side is delimited by the functional unit 2 and on the outflow side is delimited by the impact face 6.

The flow-determining functional unit 2 has at least one flow rate regulator 15 and/or at least one throttle. In general, it can be said that the functional unit modifies or can modify the flow rate, and/or that there is a pressure differential between the portions ahead of and behind the functional unit.

A flow rate regulator 15 in the context of the invention can relate to a pressure-independent adjustment, in particular an automatic adjustment, of a flow rate taking place across an operating range of the flow rate regulator 15. It is thus possible to set a flow rate which is as consistent as possible. In contrast, in the case of the throttle the flow rate is modified as a function of the prevailing pressure.

The sanitary insert part 1 has a housing 16 into which the diffusor 4 and/or the at least one flow-determining functional unit 2 are/is at least partially inserted.

The housing 16 has a wall 17 which laterally delimits an in particular annular trap 18 which in the flow direction 3 is disposed downstream of the outlet openings 7. The trap 18 can serve for aerating the water jet and therefore can also have aeration openings for suctioning air, in particular from the outside.

The housing 16 thus influences the flow behavior of the water flowing therethrough. The housing 16, conjointly with the diffusor 4, thus defines the flow direction 3 of the water through the built-in part 1, and/or contributes toward shaping the jet and/or aerating the jet. There thus exists an interaction between the diffusor 4 and the housing 16 that determines the shape of the outflow jet, which is why the housing 16 may also be referred to as the diffusor ring 23.

A plurality of splitter elements 19 which are in particular disposed on a circular path are configured on and/or at the periphery of the impact face 6. The splitter elements 19 in the flow direction 3 are disposed upstream of the outlet openings. Said splitter elements 19 in the variant embodiment shown divide the edge and/or an outer periphery 20 of the drainage ramp 8 into sub-portions.

For example, the splitter elements 19 can be configured as ramps and/or wedges which ascend in the direction of the outlet openings, as is illustrated in FIGS. 1 to 6.

A step 22 which leads to a collection chamber 21 that in the flow direction 3 is disposed downstream of the drainage ramp is configured after the drainage ramp 8. The collection chamber 21 thus represents part of the diffusor space 5. The height of the collection chamber 21 is greater than the remaining part of the diffusor space 5, in particular in the region of the impact face 6.

FIGS. 1 to 6 moreover relate to a model series of at least two variants 24, 25 of sanitary insert parts 1.

The variants 24 and 25 here differ only in terms of an diffusor type which is installed therein.

The functional unit 2 and/or the housing 16, in particular the diffusor ring 23, of the two variants 24, 25 are/is designed so as to be of identical construction.

The at least two variants 24, 25 of the model series have different diffusors 4 which differ in that the at least two types of diffusors 4 have outlet openings 7 with different opening dimensions. The first variant 24 is thus assigned to a lower flow rating than the second variant 25.

It can furthermore be stated that a ratio between a width b of the respective outlet openings 7 and a respective spacing a between two adjacent outlet openings 7 is smaller in the first variant 24 than in the second variant 25.

More specifically, it can be stated that the ratio b/a of the first variant 24 is less than 0.41, and/or that the ratio b/a of the second variant 25 is 0.41 or more than 0.41.

As can be derived from FIGS. 1 and 3, the diffusor 4 of the second variant 25 does not have any drainage ramp 8. Instead, the impact face 6 here is extended and forms a sharp, in particular rectangular, edge. The water thus flows across the sharp breakaway edge and runs into the collection chamber 21.

The invention thus relates in particular to a sanitary insert part 1, having at least one flow-regulating functional unit 2 and having a diffusor 4 which in the flow direction 3 is disposed after the flow-regulating functional unit 2, wherein the diffusor 4 has a diffusor space 5, wherein the diffusor space 5 is partially delimited by an impact face 6 which deflects in a radial direction toward a plurality of outlet openings 7 water that flows into the diffusor space 5, wherein in a drainage ramp 8 which allows water impacting the impact face 6 and draining therefrom in the use position to drain in the direction of the outlet openings 7 is disposed obliquely to the impact face 6.

LIST OF REFERENCE SIGNS

1 Sanitary insert part
2 Flow-determining functional unit
3 Flow direction
4 Diffusor
5 Diffusor space
6 Impact face
7 Outlet opening
8 Drainage ramp
9 Lateral wall
10 Width (b)
11 Spacing (a)
12 Inlet opening
13 Material clearance
14 Diameter of the diffusor space
15 Flow rate regulator
16 Housing
17 Wall
18 Trap
19 Splitter element
20 Outer periphery of the drainage ramp
21 Collection chamber
22 Step
23 Diffusor ring
24 First variant
25 Second variant

The invention claimed is:

1. A sanitary insert part (1), comprising:

at least one flow-determining functional unit (2);

a diffusor (4) which in a flow direction (3) is disposed after the flow-determining functional unit (2), the diffusor (4) has a diffusor space (5) partially delimited by an impact face (6) which deflects in a lateral direction water flowing into the diffusor space (5);

a plurality of outlet openings (7) leading from the diffusor space;

wherein the impact face (6) is adjoined by a drainage ramp (8) which allows water impacting the impact face (6) and draining therefrom in a use position to drain in a direction of the outlet openings (7), and wherein an outer edge of the drainage ramp (8) is formed by a step (22) which leads to a collection chamber (21) of the diffusor space (5) that in the flow direction (3) is disposed downstream of the drainage ramp (8), and wherein the collection chamber (21) leads to the plurality of outlet openings (7);

a housing (16) in which at least one of the diffusor (4) or the at least one flow-determining functional unit (2) is inserted, the housing (16) has an encircling wall (17) which laterally delimits a trap (18) that in the flow direction (8) is disposed downstream of the outlet openings (7); and at least one splitter element (19) disposed at least one of at or on the impact face (6), and the at least one splitter element (19) is in each case disposed ahead of an outlet opening (7).

2. The sanitary insert part (1) as claimed in claim 1, wherein the outlet openings (7) penetrate an encircling lateral wall (9) of the diffusor (4), the outlet openings (7) each have a width (b, 10), two adjacent ones of the outlet openings (7) are in each case disposed at a mutual spacing (a, 11), and a ratio b/a is less than 0.41.

3. The sanitary insert part (1) as claimed in claim 1, wherein the diffusor space (5) has at least one inlet opening (12) configured such that a water jet entering through the at least one inlet opening (12) in the use position impacts the impact face (6) and is split.

4. The sanitary insert part (1) as claimed in claim 1, wherein the impact face (6) in terms of an incident angle of inflowing water jet in the use position is aligned to be perpendicular or almost perpendicular.

5. The sanitary insert part (1) as claimed in claim 1, wherein the drainage ramp (8) in relation to the impact face (6) is inclined downward and/or from an inside to an outside by an angle that is at least 5°.

6. The sanitary insert part (1) as claimed in claim 1, wherein the diffusor space (5) is configured a ring or a disk shape.

7. The sanitary insert part (1) as claimed in claim 6, wherein the outlet openings (7) are at least partially configured as material clearances (13), and the material clearances (13) each have a minimum dimension which corresponds to at least 2% of a diameter (14) of the diffusor space (5).

8. The sanitary insert part (1) of claim 1, wherein a ratio b/a between a width (b, 10) of one of the outlet openings (7) and a spacing (a, 11) between two adjacent ones of the outlet openings (7) is less than 0.41.

9. The sanitary insert part (1) as claimed in claim 1, wherein the diffusor space (5) is configured between the impact face (6) and the flow-determining functional unit (2), and a diffusor ring (23) is configured or disposed to be downstream of the outlet openings (7).

10. The sanitary insert part (1) as claimed in claim 1, wherein the flow-determining functional unit (2) has at least one of a flow rate regulator (15) or a throttle.

11. The sanitary insert part (1) as claimed in claim 1, wherein the collection chamber (21) is configured between the outlet openings (7) and an outer periphery (20) of the drainage ramp (8) within the diffusor space (5), and a height of the diffusor space (5) in a region of the collection chamber (21) is greater than a height of the diffusor space (5) in a region of the impact face (6).

12. A model series having at least two variants (24, 25) of a sanitary insert part (1), at least one said variant corresponds to the sanitary insert part (1) as claimed in claim 1, wherein each said variant has the at least one functional unit (2), at least one housing (16) and/or a diffusor ring (23), and at least one diffusor (4), the at least two variants (24, 25) have different types of the diffusors (4), the at least two types of diffusors (4) have differently configured ones of the flow-determining outlet openings (7), such that a first one of the variants has a lower flow rating than a second one of the variants.

13. The model series as claimed in claim 12, wherein a ratio b/a between a width (b, 10) of one of the outlet openings (7) and a spacing (a, 11) between two adjacent ones of the outlet openings (7) is smaller in the first variant than in the second variant.

14. The model series as claimed in claim 12, wherein the first variant (24) is configured as the sanitary insert part (1).

15. The model series as claimed in claim 13, wherein a ratio b/a of the first variant (24) is less than 0.41.

16. The model series as claimed in claim 12, wherein at least one of the housing (16) or the diffusor ring (23) of the at least two variants (24, 25) have an identical construction.

17. The model series as claimed in claim 12, wherein the second variant (25) includes a diffusor that does not have any drainage ramp (8).

18. A sanitary insert part (1), comprising:

at least one flow-determining functional unit (2);

a diffusor (4) which in a flow direction (3) is disposed after the flow-determining functional unit (2), the diffusor (4) has a diffusor space (5) partially delimited by an impact face (6) which deflects in a lateral direction water flowing into the diffusor space (5);

a plurality of outlet openings (7) leading from the diffusor space;

wherein the outlet openings (7) penetrate an encircling lateral wall (9) of the diffusor (4), the outlet openings (7) each have a width (b, 10), two adjacent ones of the outlet openings (7) are in each case disposed at a mutual spacing (a, 11), and a ratio b/a is less than 0.41.

* * * * *